US005128635A

United States Patent [19]

Vaughan et al.

[11] Patent Number: 5,128,635

[45] Date of Patent: Jul. 7, 1992

[54] HIGH POWER FERRITE CIRCULATOR HAVING HEATING AND COOLING MEANS

[75] Inventors: Thomas J. Vaughan, Rye Beach, N.H.; Erich Pivit, Allmersbach, Fed. Rep. of Germany

[73] Assignee: Ant Nachrichtentechnik GmbH, Backnang, Fed. Rep. of Germany

[21] Appl. No.: 345,179

[22] Filed: Jul. 10, 1989

[51] Int. Cl.[5] ..... H01P 1/383

[52] U.S. Cl. ..... 333/1.1; 333/24.1

[58] Field of Search ..... 333/1.1, 241-24.3

[56] References Cited

U.S. PATENT DOCUMENTS 4,717,895 1/1988 Pivit et al. ..... 333/1

*Primary Examiner*—Paul Gensler

*Attorney, Agent, or Firm*—Robert T. Dunn

[57] ABSTRACT

A high power, high frequency, Y-junction three port circulator containing at least one metal plate in the Y-junction covered with ferromagnetic material and an external magnet producing a magnetic field through the ferromagnetic material so that it is magnetized to saturation magnetization when the temperature of the material is within a predetermined temperature range; and a method and means of maintaining the temperature of the ferrite material within said predetermined range even while the circulator operates in a variable ambient environment at high power, including means connected to the metal plate for heating and cooling the plate, thereby controlling the temperature of the ferromagnetic material to maintain the temperature thereof within said predetermined temperature range.

14 Claims, 5 Drawing Sheets

HIGH POWER FERRITE CIRCULATOR HAVING HEATING AND COOLING MEANS

BACKGROUND OF THE INVENTION

The present invention relates to a transmission line junction ferrite circulator for high frequency, high power application, having a Y-junction for three transmission lines and containing one or more spaced apart metal plates in the Y-junction covered with ferrite material and an external magnet producing a magnetic field within the Y-junction that is oriented perpendicular to the ferrite covering. More particularly, the present invention provides a method and means of maintaining the temperature of the ferrite material within a predetermined range even while the circulator operates in a variable ambient environment at high power, on the order of 300 kW and at an operating frequency of 500 MHz.

The Y-junction three port circulator is a well known device. Its usual function is to feed high frequency signals entering any one of the three ports to only one of the other two ports with no reciprocity between ports. This function of the circulator depends upon the ferrite material contained in the Y-junction. When the ferrite material is magnetized by an external magnet, it becomes resonant to electro-magnetic waves of a particular frequency and that resonance gives rise to the non-reciprocal flow of signals through the junction that are at the resonant frequency.

Usually, optimum performance of the circulator is achieved by magnetizing the ferrite to saturation magnetization, because saturation magnetization tends to realize the greatest isolation between two isolated ports and the minimum insertion loss between two coupled ports.

The ferrite saturation magnetization is temperature dependent. A change in saturation magnetization can be compensated for by changing the external magnetic field and for that purpose the external magnetic field may be provided by a permanent magnet and an additional electro-magnet and so the magnetization can be changed as necessary by varying the current in the electro-magnet. In this way, a change in the temperature of the ferrite producing a change in the ferrite saturation magnetization can be compensated for to bring performance to optimum. When the saturation magnetization changes due to a temperature change, it is said that the circulator is destabilized or detuned and when compensation is made by changing the electro-magnet current, the circulator is said to be stabilized or tuned.

Stabilizing or tuning a circulator using an electro-magnet as part of the external magnetic field system requires a large electro-magnet in addition to a permanent magnet located outside of the Y-junction. This requirement increases the total size and weight of the circulator. A high power circulator incurs significant heating of the ferrite material and so must be tuned over a relatively wide range of saturation magnetization and this requires large structural size and weight to accommodate the larger magnet system.

Heretofore, the ferrite material in a high power circulator has been cooled using a liquid coolant system with fluid passages inside the Y-junction adjacent the ferrite material therein. A high power waveguide Y-junction circulator of this type is described in U.S. Pat. No. 4,717,895, entitled High Frequency, High Power Waveguide Junction Circulator, which issued Jan. 5, 1988 to Erich Pivit, et al. That patient describes a Y-junction of waveguides with one or more thin metal discs in the junction, each covered on both sides with a layer of ferrite material. The metal discs are oriented at the junction perpendicular to the electric field of waves propagating through the junction and so they do not cause excessive reflections. Heat produced in the layers of ferrite material is carried away by the metal discs and carried from the metal discs to an external reservoir or heat sink for the coolant fluid. For this purpose, a coolant fluid tube or pipe is contained within the metal disc.

The fluid cooled circulator described in the above mentioned patent is intended to carry heat from the ferrite inside the Y-junction to the coolant reservoir outside the junction Clearly, this sort of operation intends that the ferrite temperature be stabilized at a value above the coolant reservoir temperature and above ambient temperature. For example, for the high power waveguide Y-junction circulator described in the above mentioned patent with a liquid coolant system, the desired temperature of the ferrite might be 30° C. and the coolant reservoir temperature might be 25±5° C. Coolant flow would be adjusted to maintain a fixed coolant differential temperature calculated to maintain the ferrite at the desired 30° C. and so an increase in high frequency power through the circulator would require an increase in the coolant flow. With this coolant system, problems can arise when cooling is excessive, which may occur when RF power is reduced or when the coolant reservoir temperature is lower than usual as when the ambient temperature may be lower than usual. Also, the coolant system is not effective to stabilize the ferrite temperature when the ferrite temperature is below the desired value.

SUMMARY OF THE INVENTION

It is an object of the invention to provide a Y-junction circulator for high frequency, high power application, of relatively small size and weight and not dependent upon changing an electro-magnet coil current to compensate for changes of the saturation magnetization of the ferrite.

It is an object of the invention to provide a Y-junction circulator for high frequency, high power application of relatively small size and weight and not dependent upon changing an electro-magnet coil current to compensate for changes in the temperature of the ferrite.

It is another object of the present invention to provide a method and means of cooling and/or heating the ferrite material in a Y-junction ferrite circulator to maintain the temperature of the ferrite material within a predetermined range.

The above and other objects of the present invention are accomplished by heating and/or cooling the ferrite material in the circulator to maintain the ferrite temperature at a selected desired value that is above the temperature of the cooling medium. In a preferred embodiment, the saturation magnetization is accomplished by pre-magnetization of the ferrite material in the circulator so that a predetermined saturation magnetization of the ferrite is accomplished and that saturation magnetization corresponds to the selected predetermined ferrite temperature that is above the temperature of the cooling medium. Thereafter, any tendency of the ferrite temperature to increase or decrease from that selected predetermined temperature is effectively compensated for by cooling or heating the ferrite. With this system little or no compensation need be effected by changing the magnet system (varying the electro-magnet coil current).

Several techniques are described herein and incorporated in embodiments of the invention for cooling and heating the ferrite material as required to maintain the selected ferrite temperatures. For example, heating is accomplished with an electric heating element contained within the thin metal plates that carry the ferrite material inside the junction, or by heating the cooling medium so that the cooling medium heats the ferrite rather than cooling the ferrite. Cooling is accomplished by a forced flow of liquid or gaseous cooling medium through the thin metal plates that carry the ferrite material, or one or more heat pipes thermally connect to each metal plate and pass through the junction wall to a heat exchanger outside of the junction. Such heat pipes can function to heat or cool the ferrite layers carried by the metal plates.

These and other objects and features of the present invention are described more fully herein and below with reference to the drawings.

DESCRIPTION OF EMBODIMENTS OF THE INVENTION

The Y-junction circulators described herein can be constructed for operation carrying high frequency power of 300 kW, or more, at 500 MHz. With capacities of this order, they can be used in the transmission line system of a TV broadcast antenna or to feed high frequency energy to the resonant cavities of a particle accelerator or for industrial microwave heating applications where such power is required. When used in a system where the power source is a high power klystron, the circulator can serve to decouple the klystron from the load, such as the antenna, so that the klystron will not be damaged by reflected power.

Figure 1:
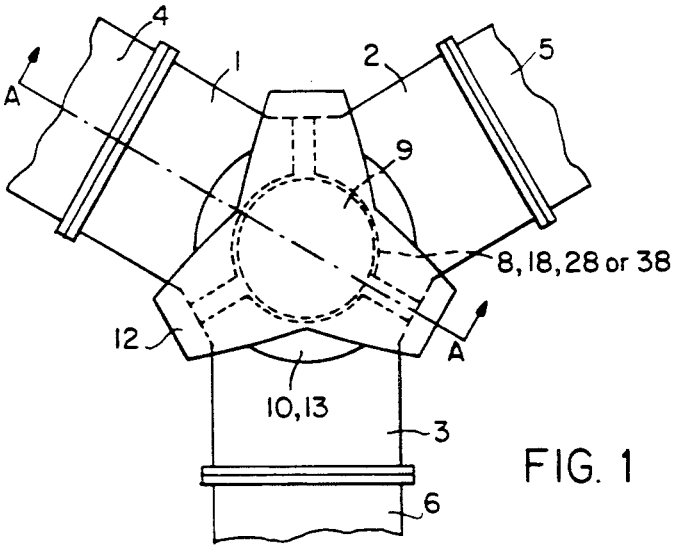
FIG. 1 is a plan view of a waveguide junction circulator according to the present invention.
Figure 2:
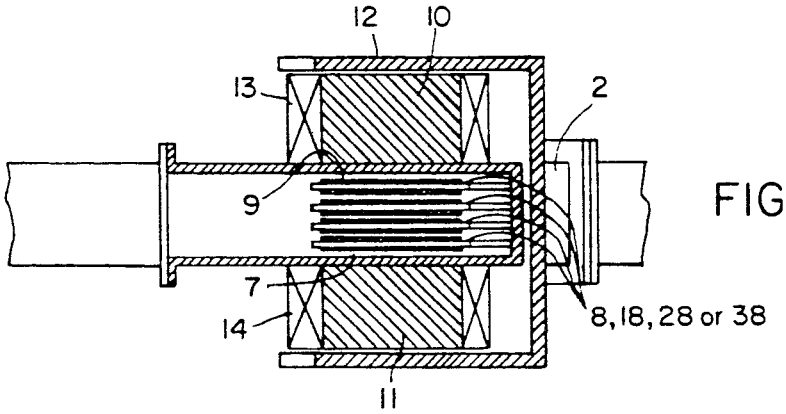
FIG. 2 is a longitudinal sectional view along line A—A of the waveguide junction circulator of FIG. 1.

As shown in FIG. 1, the waveguide Y-junction embodiment of the circulator has three junction arms 1, 2 and 3 mutually offset from one another by 120° and connected with connecting waveguides 4, 5 and 6, respectively. The internal structure and arrangement of the magnet system of the circulator is shown in FIG. 2 which is a sectional view of FIG. 1 along line A—A which passes through the longitudinal axis of junction arm 1.

Inside the Y-junction in space 7 from which arms 1, 2 and 3 branch out, are four spaced metal plates 8, 18, 28 and 38, arranged one above the other. These metal plates 8, 18, 28 and 38 serve as carriers for ferrite discs 9 attached to the upper and undersides of each plate The ferrite material (also called ferromagnetic material) which produces the non-reciprocal effect of the circulator is divided into the plurality of thin discs 9 to maintain a minimum the temperature gradient produced in the ferrite material by the high operating power. The division of the ferrite material into a plurality of thin discs has the result that the "effective filling factor", which is the ratio of the sum of the thicknesses of all ferrite discs to the total height of space 7 (also the height of the waveguide arms) may be less than in conventional waveguide circulators operated at lower power. Since "filling factor" and band width are proportional to one another, the realizable band width for extremely high power circulators is generally less than for small signal circulators.

Figure 3:
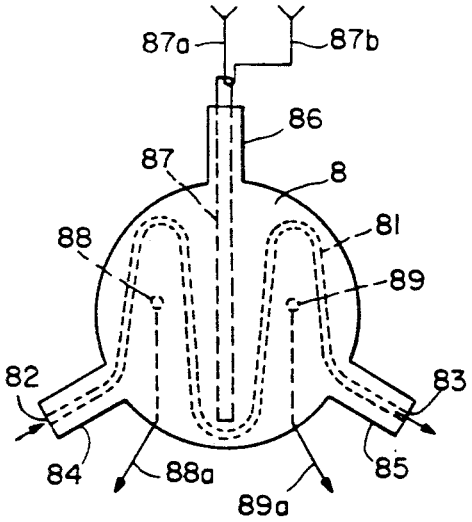
FIG. 3 is a plan view of a metal plate arranged inside the circulator junction for carrying one or more layers of ferrite material inside the junction and shows parts of a liquid cooling system, an electric heating system and a ferrite temperature detection and control system.
Figure 4:
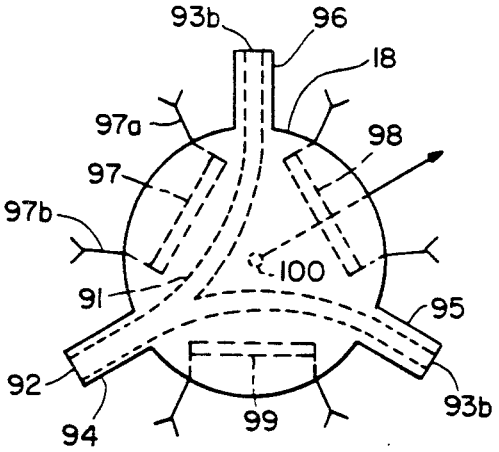
FIG. 4 is a plan view of another embodiment showing the metal plate for carrying the ferrite material in the Y-junction and showing parts of an air cooling system, an electric heating system and a ferrite temperature detection and control system.

To dissipate the heat produced in the ferrite discs, metal plates 8, 18, 28 and 38 may be provided with passages through which a fluid coolant flows. For example, the coolant fluid may be a liquid and a passage (path) for the liquid coolant may be provided through the plate as shown in FIG. 3. Or, the coolant fluid may be a gas and passages for the gas to flow through the plate may be provided as shown in FIG. 4. The ferrite discs 9 may be made of suitable ferrite material which is usually distinguished by very low attenuation of 0.04 db at 500 MHz and has, for example, a saturation magnetization, $4\pi M$, of about 1,000 Gauss and a line width $\Delta H$ of about 20 Oersteds. The ferrite discs 9 may each be composed of a plurality of triangular segments which are glued onto metal plates 8 with a small air gap (approximately 50μm) remaining between adjacent segments).

The magnetic field through the ferrite discs, perpendicular to the planes of the discs to produce the saturation magnetization condition is provided by an external permanent magnet and is supplemented by an external electro-magnet. The permanent magnet is composed of two magnetic cores 10 and 11 disposed above and below the cavity 7, respectively, with their magnetic flux returning via yoke 12. The external electro-magnetic may be provided by electric coils 13 and 14 that surround the permanent magnet cores 10 and 11, respectively. This structure is described more fully in the above mentioned U.S. Pat. No. 4,717,895.

Figure 10:
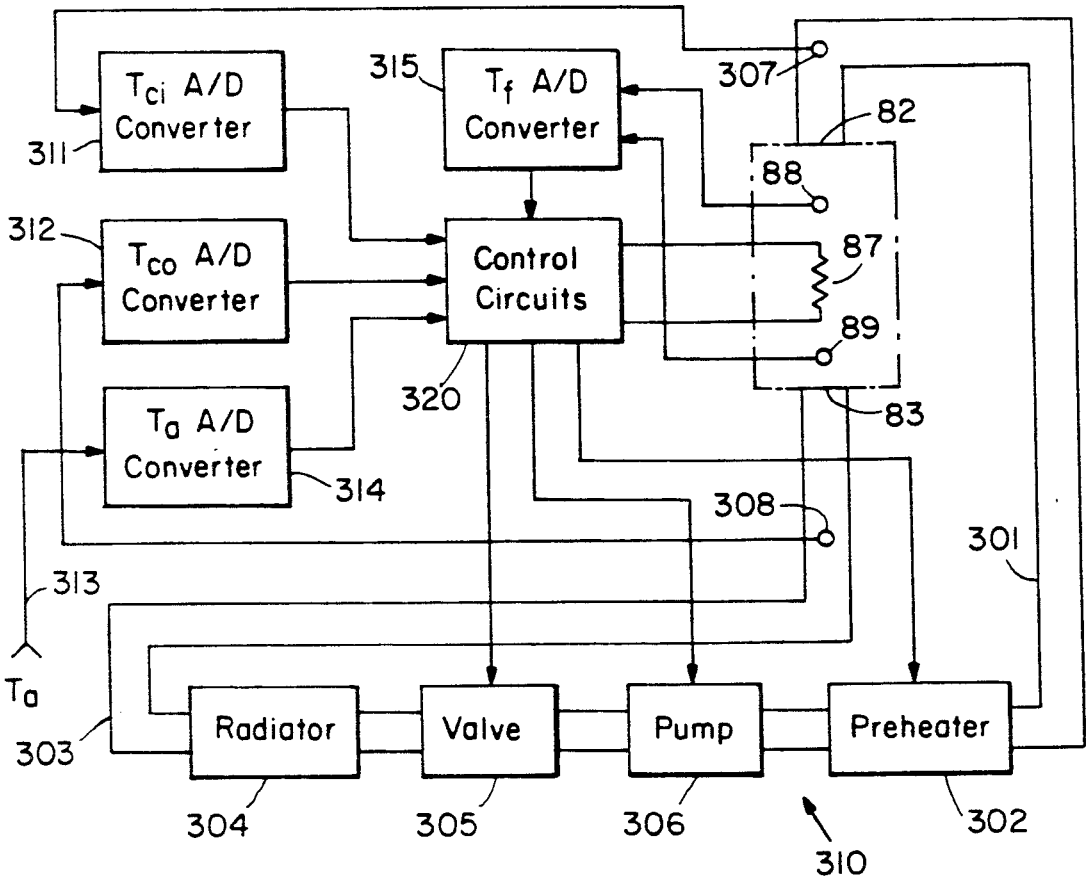
FIG. 10 is a schematic block diagram showing other parts of the liquid cooling system, electric heating system and ferrite temperature detection control system for operation with the plate shown in FIG. 3.

As shown in FIG. 3, the liquid coolant passage, represented by a dotted line 81 winds through the interior of plate 8 and has an inlet 82 and outlet 83 at the extending arms 84 and 85 of the plate that connect to the side walls of the junction and meet with suitable connectors to and from the liquid coolant system shown schematically in FIG. 10. An electric heating element 87 is shown by broken lines in FIG. 3 extending into the plate via the third support projection 86 of the plate. This heating element may be rod shaped and inserted into a hole drilled into the plate from the side through support 86 to accommodate the rod and electric leads 87*a* and 87*b*. The element may extend through the side wall of the junction for connection to the control circuits of the system shown in FIG. 10. The temperature of the plate is detected by one or more temperature detectors 88 and 89 suitably located in the plate and leads from those detectors represented by leads 88*a* and 89*a*, respectively, carry signals therefrom to the control circuits of the system shown in FIG. 10

Turning next to FIG. 4 there is shown another embodiment of the plate wherein a gaseous fluid coolant such as air is forced through passages in the plate. Here, the plate 18 has three support projections 94 to 96 and an air flow passage 91 entering projection 94 at 92 and emerging from projections 95 and 96 at 93*a* and 93*b*, respectively. These exit and entrance passage to 91 feed through the side walls of the junction to an air flow system which may be similar to the liquid pumping system shown in FIG. 10 and so cools the plate Several electric heating elements 97 to 99 are embedded in the plate and a temperature detector 100 located at the center of the plate provide a signal in lead 100*a* which is indicative of the plate temperature. The electric heating element and the temperature sensing lead all connect to control circuits of a system similar to the system shown in FIG. 10 for controlling the temperature of the ferrite material attached to disc 18. For this purpose there are two electric leads from each of the heating elements 97 to 99. For example, the leads from element 97 are denoted 97*a* and 97*b*.

Figure 5:
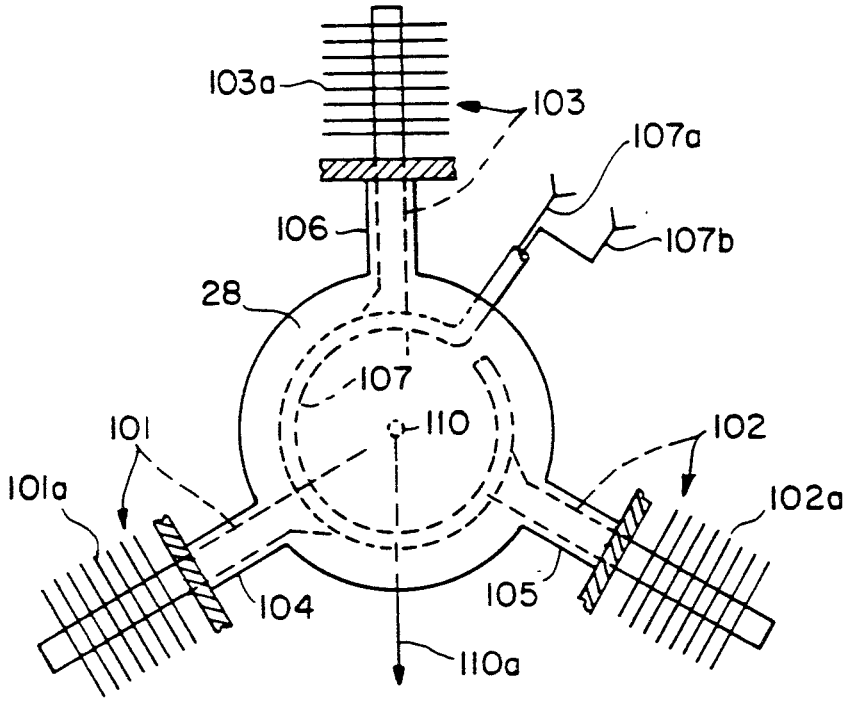
FIG. 5 is a plan view of another embodiment showing the metal plate for carrying the ferrite material in the junction and showing parts of a heat pipe cooling system, an electric heating system and a ferrite temperature detection and control system.

Turning next to FIG. 5 there is shown another embodiment of the plate which is denoted 28 in this embodiment. Here cooling is accomplished by heat pipes that conduct heat from inside of the plate to heat exchangers outside of the junction. The plate 28 has three support projections 104 to 106 for attaching the plate to the inside walls of the junction and serving also to carry heat pipes 101, 102, and 103. These heat pipes contain suitable heat exchanging materials sealed therein so that the heat exchanging materials flow inside of the plate. The heat pipes extend through the side walls of the junction to one or more heat exchangers on the outside of the junction. For example, the heat pipes 101 to 103 connect thermally to heat exchangers 101*a* to 103*a*, respectively. In this embodiment, the heat pipes serve only to cool the plate by conducting heat therefrom and discharging the heat into the ambient air via the finned heat exchangers.

Plate 28 in FIG. 5 is heated by a circular heating element 107 that may feed into the plate from the side through a side wall of the junction. Electric leads for the element 107 are denoted 107*a* and 107*b*. A temperature detector 110 may be located at the center of the plate and a signal therefrom in line 110*a* is fed to control circuits of the control system shown in FIG. 11.

Figure 6:
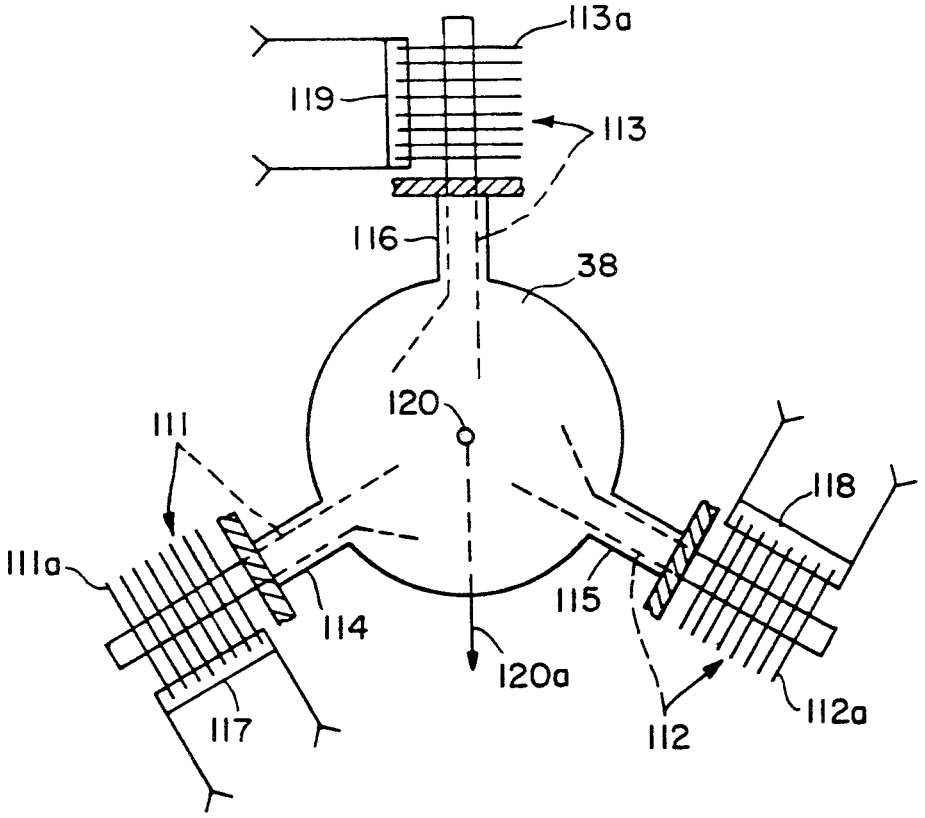
FIG. 6 is a plan view of another embodiment showing the metal plate for carrying the ferrite material in the junction and showing parts of a heat pipe cooling and heating system and a heat pipe heat exchanger for operation to cool or to heat the disc and a temperature detection control system.

Turning next to FIG. 6, there is shown another embodiment of the present invention wherein the plate 38 is both cooled and heated via one or more heat pipes. Here, the plate 38 is mounted inside the junction by projections 114 to 116 and the heat pipes 111 to 113 are carried inside the plate via projections 114 to 116, respectively. In the cooling mode, the heat exchanging materials inside the heat pipes carry heat from the plate to cooling fins attached to the heat pipe. For example heat pipe 111 has fins 111*a* attached thereto outside of the junction where ambient air flows around the fins and carries the heat into the atmosphere, just as also in the embodiment shown in FIG. 5.

In the heating mode, the same heat pipes carry heat to plate 38 to raise the temperature of the plate. For the heating mode, it is not always sufficient to rely upon the ambient air temperature to supply heat to the fins to be carried to the plate; it is necessary to heat the fins using a source that is hotter than ambient air. For that purpose, electric heating elements 117 to 119 may be attached to fins 111*a* to 113*a*, respectively. The temperature of the plate is detected by detector 120 and a signal represented thereof is coupled via lead 120*a* to the control circuits of the system shown in FIG. 12.

The waveguide Y-junction circulator shown in FIGS. 1 and 2 and described herein and also the circulator described in the above mentioned U.S. Pat. No. 4,717,895 can be loaded with a plurality or cooling plates spaced apart as shown in FIG. 2 and each carrying two layers of ferrite material. Using several thin plates such as the plates described herein each carrying two layers of ferrite material, one on each side, the effective "filling factor" can be made relatively large, because the waveguide circulator permits this stacking. A coaxial circulator can also make use any of the metal plate structures, and temperature control techniques described hereinabove with reference to FIGS. 3 to 6. However, a coaxial Y-junction circulator can only have one such disc loaded into the junction.

Figure 7:
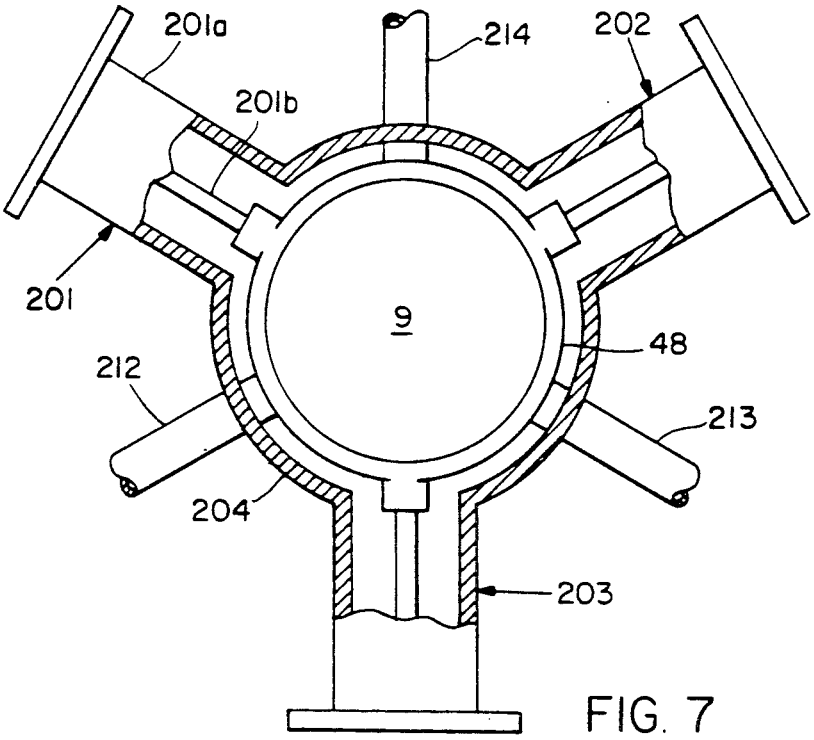
FIG. 7 is a plan view of a coaxial Y-junction circulator according to the present invention showing part of the junction broken away to reveal the metal plate and ferrite layers carried on the plate inside the junction with heating/cooling accommodations extending therefrom.
Figure 8:
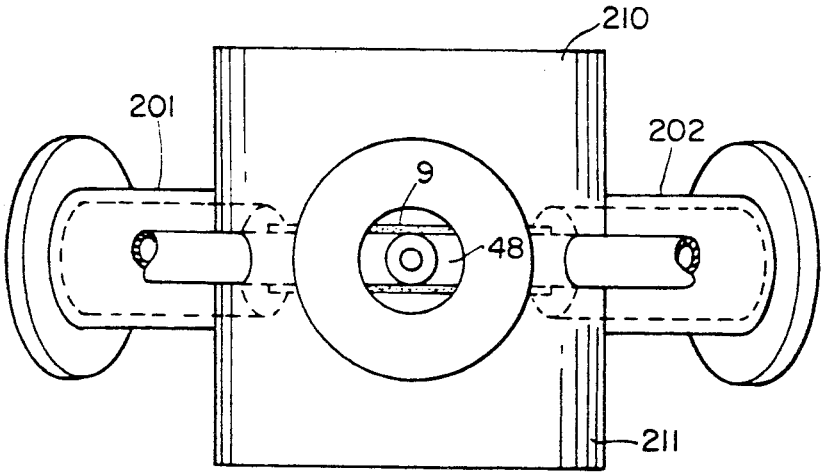
FIG. 8 is a front view of the coaxial junction circulator of FIG. 7.
Figure 9:
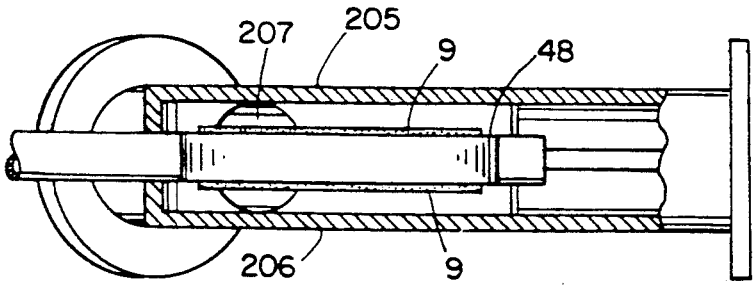
FIG. 9 is a longitudinal sectional view along line B—B of the coaxial Y-junction circulator shown in FIG. 7.

A coaxial Y-junction circulator according to the present invention is shown in FIGS. 7 to 9. Here the junction has three coaxial junction arms 201, 202 and 203 mutually offset from one another by 120° and each has an outer conductor such as 201*a* and an inner conductor such as 201*b*. The junction from which the arms 201, 202 and 203 branch out is defined by side walls 204, a top wall 205 and a bottom wall 206 defining the junction space 207 that is common to the three arms. Metal plate 48 is contained within space 207 as shown and may be attached to the side walls 204 by heat conductors (shown as pipes) 212 to 214, which connect to passages inside of plate 48 for heating or cooling the plate using any of the techniques described hereinabove with reference FIGS. 3 to 6. Electrical heater leads and temperature sensor leads to and from the plate pass through suitable openings in side wall 204 to control systems such as shown in FIGS. 10, 11 and 12, depending upon the particular structure of the plate that is used.

The center conductor of arms 201 to 203 connect directly to the edge of the plate as shown in the Figures. It is important that there be no short circuit from the plate to the side, top or bottom walls of the junction. Hence, heat conducting tubes 212 to 214 are preferably made of electrically insultating material at least between the edge of the plate and the side walls of the junction.

Figure 11:
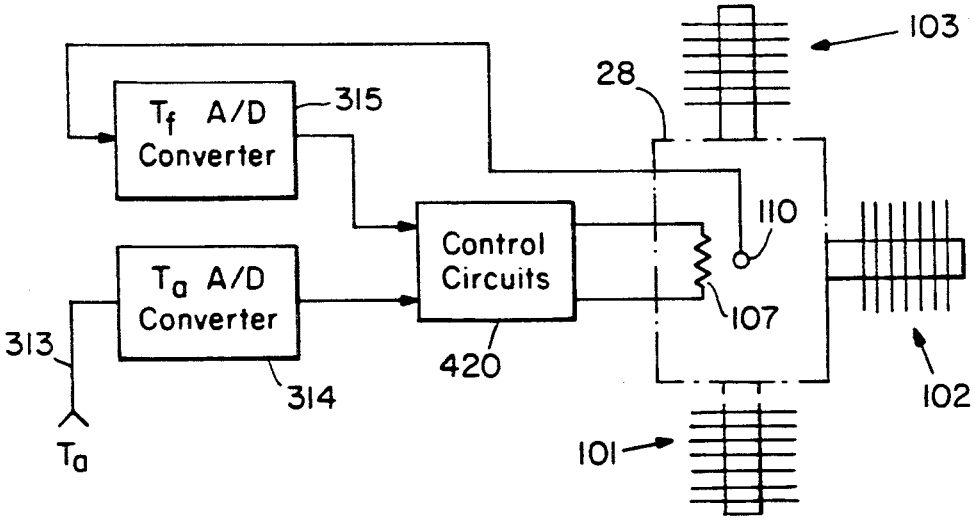
FIG. 11 is a schematic block diagram of the control system for use with the plate shown in FIG. 5.
Figure 12:
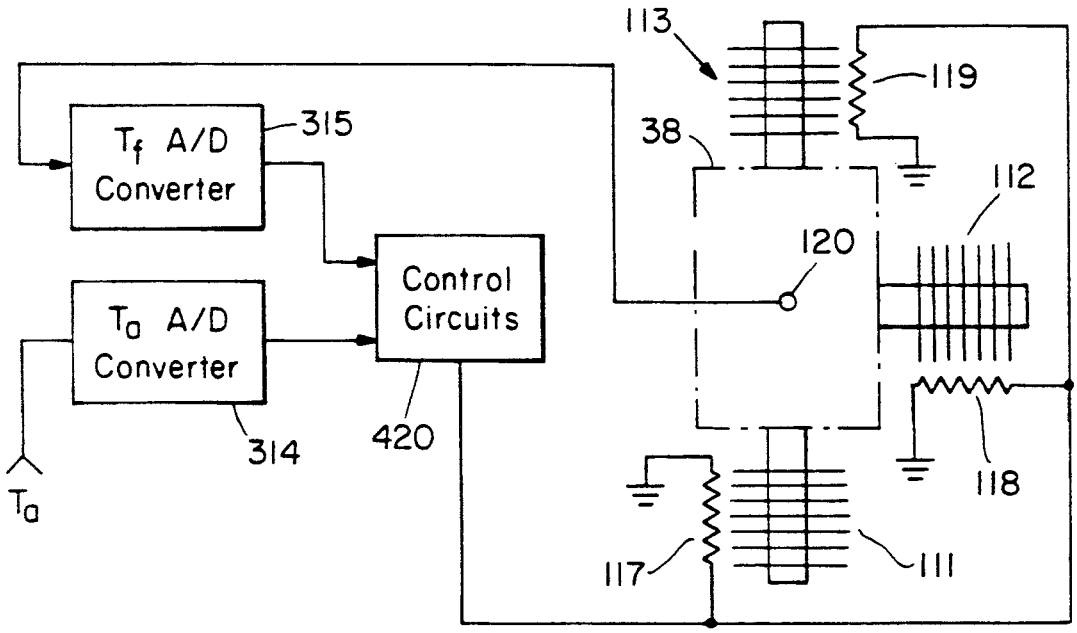
FIG. 12 is a schematic block diagram of the control system for use with the plate shown in FIG. 6.

Turning next to the control system diagrams shown in FIGS. 10, 11 and 12, FIG. 10 shows the control system using plates as shown in FIG. 3 for either a waveguide circulator or a coaxial circulator where the plate, and thus the ferrite, is cooled by liquid coolant flow through the by an electrical heating element in the plate as shown in FIG. 3. The liquid coolant is fed into plate 8 at 82 via pipe 301 from preheater 302 and flows from the plate at 83 via pipe 303 to heat exchanger or radiator 304 of the liquid cooling/heating system 310.

From the radiator, the liquid flow is turned on and off by fluid valve 305 and is pumped by fluid pump 306 through preheater 302 to the plate. Fluid temperature detectors 307 and 308 in pipes 301 and 303 detect the fluid temperature at the entrance and exit (Tci and Tco) to the plate and signals representing Tci and Tco are converted to digital numbers by analog to digital (A/D) converters 311 and 312 and fed to the control circuits 320. Similarly, ambient temperature Ta detected at 313 is converted to a digital signal by A/D converter 314 and the digital representation thereof is fed to control circuits 320. Other inputs to control circuits 320 include the plate (ferrite) temperature Tf from temperature sensors 88 and 89 embedded in plate 8, which are converted to a digital representation by A/D converter 315.

Thus, the inputs to control circuits 320 include Tf, Ta, Tci and Tco. Outputs control signals from control circuits 20 include control signals for: electric heating power to electric heating element 87; electric heating power to preheater 302; electric drive power to pump 306 and a control signal to valve 305.

In operation, control circuits 320 may operate essentially as follows: Tci, Tco and Ta are combined to produce a signal denoted It and It controls electric power to heating element 87 embedded in plate 8. Meanwhile, the plate temperature Tf from detectors 88 and 89 is examined for a high value that causes pump 306 to turn on and valve 305 to open providing a heavy flow of coolant through the plate to carry heat from the plate and dissipate the heat in radiator 304. On the other hand when Tf is below a predetermined low temperature value, it signifies that additional heat is needed from the fluid system and so again pump 306 and valve 305 are turned on; and in addition, preheater 302 is turned on so that the coolant becomes a heating fluid and carries heat to the plate. Thus, all of the control heating and cooling parameters play a part in heating/cooling the plate with the system shown in FIG. 10 controlling a circulator having a plate or plates like the plates shown in FIG. 3. Clearly, some of these parameters could be omitted and with the control system shown in FIG. 10 still achieve satisfactory heating/cooling of the plate even during high power operation to maintain the circulator stability.

A control system similar to the control system shown in FIG. 10 could be used with the plate shown in FIG. 4 where the coolant is air flow through the plate. In that case, the valve and pump in FIG. 10 would be an air valve and an air pump instead of a liquid coolant valve and pump.

Cooling the plate with heat pipes as illustrated in FIG. 5 may be controlled by a system such as shown in FIG. 11. In this system, inputs to the control circuits 420 are Tf and Ta and the only output of the control circuits is electric current to heating element 107. Cooling plate 28 occurs without control via heat pipes 101 to 103 that dump the heat into ambient air flow. Clearly, the efficiency of this cooling depends upon the ambient temperature and for that reason Ta is an input to control circuits 420.

Cooling and heating the plate 38 by heat pipes as illustrated in FIG. 6 may be accomplished using the control systems shown in FIG. 12. Here, as in FIG. 11, there are two inputs to control circuits 420, Tf and Ta, and cooling is accomplished only via heat pipes 111 to 113. However, heating is also accomplished via those heat pipes and there may not be a need for an electric resistance heating element imbedded in the plate. Here, the control circuits 420 control heating current flow to heating elements 117 to 119 that feed heat into heat tubes 111 to 113, respectively, via their cooling fins. An advantage of this system is that plate 38 need not be implemented with embedded coolant flow passages and imbedded electric heating elements.

It will be understood that the several embodiments of the present invention described herein may be modified by those skilled in the art without deviating from the spirit and scope of the invention as set forth in the appended claims.

What is claimed is:

1. A high frequency ferrite electric wave signal device for conducting a high frequency electric wave signal from one transmission line to another transmission line comprising, (a) an electromagnetic wave conducting structure having at least one non-reciprocal ports of which one of said ports is connected to said one transmission line and another of said ports is connected to said other transmission line, (b) said one port is an input port of said structure and said other port is an output port of said structure, (c) at least one body of ferromagnetic material in said structure in the path of electromagnetic waves entering said structure at said input port, (d) means for producing a magnetic field through said body of ferromagnetic material, (e) whereby said ferromagnetic material therein is magnetized to saturation magnetization when the temperature of said body is within a predetermined temperature range and said ferromagnetic material has non-reciprocal electromagnetic wave propagating characteristics at a gyromagnetic resonance frequency thereof, (f) a source of high frequency electric wave signals that feeds said input transmission line, (g) said gyromagnetic resonance frequency, the frequency of said wave signals from said source of high frequency electric wave signals and the orientation and temperature of said body of ferromagnetic material being such that said wave signals are conducted non-reciprocally through said structure from said input transmission line to said output transmission line and (h) means connected to said body of ferromagnetic material for cooling and heating said body of ferromagnetic material to maintain the temperature thereof within said predetermined temperature range.

2. A device as in claim 1 wherein, (a) said means connected to said body of ferromagnetic material includes a source of energy and means for coupling energy from said source to said body of ferromagnetic material, (b) whereby said body of ferromagnetic material is heated by energy from said source.

3. A device as in claim 1 wherein, (a) said means connected to said body of ferromagnetic material includes a temperature sink and a thermal conductor for thermally coupling said body of ferromagnetic material to said temperature sink and (b) means are provided for cooling said temperature sink, (c) whereby said body of ferromagnetic material is cooled by the flow of heat therefrom to said temperature sink.

4. A device as in claim 1 wherein, (a) said means connected to said body of ferromagnetic material includes a temperature sink and a thermal conductor for thermally coupling said body of ferromagnetic material to said temperature sink and (b) means are provided for heating said temperature sink, (c) whereby said body of ferromagnetic material is heated by the flow of heat therefrom to said temperature sink.

5. A device as in claim 1 wherein, (a) said means connected to said body of ferromagnetic material includes a temperature sink and a thermal conductor for thermally coupling said body of ferromagnetic material to said temperature sink and (b) means are provided for cooling said temperature sink, (c) whereby said body of ferromagnetic material is cooled by the flow of heat therefrom to said temperature sink and (d) means are provided for heating said temperature sink, (e) whereby said body of ferromagnetic material is heated by the flow of heat therefrom to said temperature sink.

6. A device as in claim 1 wherein, (a) said means connected to said body of ferromagnetic material maintains the temperature of said body within said predetermined temperature range while the power of said high frequency electric wave signals conducted through said structure varies over a relatively wide power range.

7. A device as in claim 6 wherein, (a) said means connected to said body of ferromagnetic material includes a heat sink and a thermal conductor for thermally coupling said body of ferromagnetic material to said heat sink, (b) whereby said body of ferromagnetic material is cooled by the flow of heat therefrom to said heat sink.

8. A device as in claim 1 wherein, (a) said means connected to said body of ferromagnetic material includes a heat sink and a thermal conductor for thermally coupling said body of ferromagnetic material to said heat sink, (b) whereby said body of ferromagnetic material is cooled by the flow of heat therefrom to said heat sink, 9. A device as in claim 8 wherein, (a) said means connected to said body of ferromagnetic material also includes a source of energy and means for coupling energy from said source of energy to said body of ferromagnetic material, (b) whereby said body of ferromagnetic material is cooled by said heat sink and heated by said source as required to maintains the temperature of said body of ferromagnetic material within said predetermined temperature range while the power of said high frequency electric wave signals conducted through said structure varies over a relatively wide power range.

10. A device as in claim 8 wherein, (a) said thermal conductor includes a thermally conductive body in said structure in intimate thermal contact with said body of ferromagnetic material and (b) means for thermally coupling heat from said thermally conductive body to said heat sink, (c) said thermally conductive body has orthogonal major and minor dimensions and said minor dimension is parallel to the electric field of said high frequency wave signals from said input transmission line propagating in said structure, (d) said thermally conductive body and said means for thermally coupling heat therefrom to said heat sink contains fluid transport passages for cooling fluid that carries heat from said body of ferromagnetic material to said heat sink and (e) said means connected to said body of ferromagnetic material includes a source of energy and means for coupling energy from said source to said body of ferromagnetic material, (f) whereby said body of ferromagnetic material is heated by energy from said source of energy.

11. A device as in claim 8 wherein, (a) said thermal conductor includes a thermally conductive body in said structure in intimate thermal contact with said body of ferromagnetic material and (b) means are provided for thermally coupling heat from said thermally conductive body to said heat sink.

12. A device as in claim 11 wherein, (a) said thermally conductive body has orthogonal major and minor dimensions and said minor dimension is parallel to the electric field of said high frequency wave signals from said input transmission line propagating in said structure.

13. A device as in claim 11 wherein, (a) said thermally conductive body and said means for thermally coupling heat therefrom to said heat sink contains fluid transport passages for cooling fluid that carries heat from said body of ferromagnetic material to said heat sink.

14. In a high frequency circulator including a central junction of three junction arms connecting with three high frequency transmission lines, a source of high frequency electric wave signals that feeds one of said transmission lines, at least one body of ferromagnetic material in said central junction and means for producing a magnetic field through said body of ferromagnetic material so that said ferromagnetic material therein is magnetized to saturation magnetization when the temperature of said body is within a predetermined temperature range and said ferromagnetic material has nonreciprocal electromagnetic wave propagating characteristics at a gyromagnetic resonance frequency thereof, the improvement comprising, (a) said gyromagnetic resonance frequency, the frequency of said wave signals from said source of high frequency electric wave signals and the orientation and temperature of said body of ferromagnetic material being such that said wave signals are conducted non-reciprocally through said structure from said one transmission line to another of said transmission lines and (b) means connected to said body of ferromagnetic material for cooling and heating said body of ferromagnetic material to maintain the temperature thereof within said predetermined temperature range.

* * * * *